US012564298B2

(12) United States Patent
Wu

(10) Patent No.: US 12,564,298 B2
(45) Date of Patent: Mar. 3, 2026

(54) MAGNETIC HINGE CONNECTION FOR TOILET LID AND SEAT

(71) Applicant: Topseat International, Inc., Plano, TX (US)

(72) Inventor: Chengdong Wu, Allen, TX (US)

(73) Assignee: Topseat International, Inc., Plano, TX (US)

( * ) Notice: Subject to any disclaimer, the term of this patent is extended or adjusted under 35 U.S.C. 154(b) by 158 days.

(21) Appl. No.: 18/348,642

(22) Filed: Jul. 7, 2023

(65) Prior Publication Data

US 2025/0009194 A1 Jan. 9, 2025

(51) Int. Cl.
*A47K 13/12* (2006.01)

(52) U.S. Cl.
CPC ..... *A47K 13/12* (2013.01)

(58) Field of Classification Search
CPC ..... A47K 13/26; A47K 13/12
See application file for complete search history.

(56) References Cited

U.S. PATENT DOCUMENTS

| | | | | |
|---|---|---|---|---|
| 1,799,309 A | | 4/1931 | Mears | |
| 3,038,173 A | * | 6/1962 | Turek | A47K 13/26 4/236 |
| 3,550,164 A | * | 12/1970 | Pease | A47K 13/26 4/236 |
| 3,561,317 A | | 2/1971 | Rowell | |
| 3,568,221 A | | 3/1971 | Haldopoulos | |
| 3,699,614 A | | 10/1972 | Stairs | |
| 3,742,583 A | | 7/1973 | Devlin et al. | |
| 4,011,786 A | | 3/1977 | Liebig | |
| 4,015,505 A | | 4/1977 | Murray | |
| 4,029,379 A | | 6/1977 | Kotala et al. | |
| 4,080,671 A | | 3/1978 | Stahli | |
| 4,087,884 A | | 5/1978 | Seiderman | |
| 4,148,104 A | | 4/1979 | Ginsburg | |
| 4,159,548 A | | 7/1979 | Hewson | |
| 4,290,337 A | | 9/1981 | Kuwata et al. | |
| 4,293,259 A | | 10/1981 | Liebig | |
| 4,314,382 A | | 2/1982 | Ginsburg et al. | |
| 4,319,365 A | | 3/1982 | Bemis et al. | |
| 4,326,307 A | | 4/1982 | Baillie et al. | |

(Continued)

FOREIGN PATENT DOCUMENTS

| | | | |
|---|---|---|---|
| CN | 101999857 A | * | 4/2011 |
| CN | 202122545 U | | 1/2012 |

(Continued)

OTHER PUBLICATIONS

International Search Report and Written Opinion of the International Searching Authority dated Oct. 4, 2023, in connection with International Application No. PCT/US2023/027246, 9 pages.

*Primary Examiner* — Christine J Skubinna

(57) ABSTRACT

A hinge assembly for a toilet seat includes a mounting base configured to be coupled to a toilet bowl, the mounting base comprising a mounting cup. The hinge assembly also includes a mounting post configured to be coupled to the toilet seat and configured to be inserted into the mounting cup. At least one of the mounting cup and the mounting post comprises a magnet such that the mounting post and the mounting cup form a magnetic connection when the mounting post is inserted into the mounting cup.

18 Claims, 12 Drawing Sheets

(56) References Cited

U.S. PATENT DOCUMENTS

| | | | | |
|---|---|---|---|---|
| 4,384,375 | A * | 5/1983 | Gerome | A47K 13/26 16/382 |
| 4,391,001 | A | 7/1983 | Harrison | |
| 4,398,307 | A | 8/1983 | Ginsburg et al. | |
| 4,416,048 | A | 11/1983 | Otte | |
| 4,467,481 | A | 8/1984 | Ginsburg | |
| 4,514,356 | A | 4/1985 | Harrison | |
| 4,659,267 | A | 4/1987 | Uno et al. | |
| 4,729,703 | A | 3/1988 | Sato | |
| 4,819,522 | A | 4/1989 | Stinson | |
| 4,878,255 | A | 11/1989 | Grimstad et al. | |
| 4,921,381 | A | 5/1990 | Gschwend et al. | |
| 4,965,889 | A | 10/1990 | Tissot et al. | |
| 5,010,601 | A | 4/1991 | Kobayashi et al. | |
| 5,108,238 | A | 4/1992 | Ewing | |
| 5,314,277 | A | 5/1994 | Fischer | |
| 5,933,875 | A | 8/1999 | Hulsebus et al. | |
| 6,012,886 | A | 1/2000 | Tanamura et al. | |
| 6,026,520 | A | 2/2000 | Pedersen | |
| 6,070,295 | A | 6/2000 | Hulsebus | |
| 6,234,734 | B1 | 5/2001 | Klippel | |
| 6,381,762 | B1 | 5/2002 | Moser | |
| 6,763,529 | B1 | 7/2004 | Richter | |
| 6,807,686 | B1 | 10/2004 | Janes | |
| 6,931,672 | B1 | 8/2005 | Richter | |
| 7,155,748 | B2 | 1/2007 | Vierkant, III et al. | |
| 7,203,975 | B2 | 4/2007 | Vierkant, III | |
| 7,204,667 | B2 | 4/2007 | Uno et al. | |
| 7,281,276 | B2 | 10/2007 | Vierkant, III et al. | |
| 7,389,549 | B2 | 6/2008 | Vierkant, III | |
| 7,566,195 | B2 | 7/2009 | Hull | |
| 7,712,157 | B2 | 5/2010 | Laundre | |
| 7,827,626 | B2 | 11/2010 | Zhou | |
| 7,845,027 | B2 | 12/2010 | Er et al. | |
| 7,857,563 | B2 | 12/2010 | Pratt | |
| 7,891,924 | B2 | 2/2011 | Mercer et al. | |
| 7,896,598 | B2 | 3/2011 | Mercer et al. | |
| 8,087,103 | B2 | 1/2012 | Leibfried | |
| 8,118,526 | B2 | 2/2012 | Dowling | |
| 8,763,168 | B2 | 7/2014 | Zhou | |
| 9,095,241 | B1 | 8/2015 | Abbuhl | |
| 2006/0021120 | A1 | 2/2006 | Nickle | |
| 2006/0113504 | A1 | 6/2006 | Tollin | |
| 2006/0156458 | A1 | 7/2006 | Myers | |
| 2007/0250996 | A1 | 11/2007 | Li | |
| 2008/0172780 | A1 | 7/2008 | Shiau | |
| 2008/0209620 | A1 | 9/2008 | Hand et al. | |
| 2008/0213063 | A1 | 9/2008 | Pratt | |
| 2008/0219799 | A1 | 9/2008 | Auriol et al. | |
| 2008/0226411 | A1 | 9/2008 | McKinlay | |
| 2009/0092462 | A1 | 4/2009 | Pratt | |
| 2009/0113610 | A1 | 5/2009 | Lin et al. | |
| 2009/0191020 | A1 | 7/2009 | Pratt | |
| 2009/0211005 | A1 | 8/2009 | Hand et al. | |
| 2009/0226278 | A1 | 9/2009 | Pratt | |
| 2010/0074710 | A1 | 3/2010 | Auriol et al. | |
| 2010/0150681 | A1 | 6/2010 | David et al. | |
| 2010/0260572 | A1 | 10/2010 | Wehrmeister et al. | |
| 2010/0275353 | A1 | 11/2010 | Gong | |
| 2011/0000010 | A1 | 1/2011 | Henne | |
| 2011/0058916 | A1 | 3/2011 | Toosky | |
| 2012/0042502 | A1 | 2/2012 | Wenfeng et al. | |
| 2013/0254981 | A1 | 10/2013 | Nelson et al. | |
| 2013/0269092 | A1 | 10/2013 | Hand et al. | |
| 2015/0216379 | A1 | 8/2015 | Chen | |
| 2017/0020349 | A1 | 1/2017 | Yang | |
| 2018/0344106 | A1 * | 12/2018 | Regan | A47K 13/04 |

FOREIGN PATENT DOCUMENTS

| | | | |
|---|---|---|---|
| DE | 202020104507 | U1 | 8/2020 |
| EP | 2997868 | B1 | 12/2016 |
| WO | 2003041550 | A1 | 5/2003 |
| WO | 2014032372 | A1 | 3/2014 |

* cited by examiner

MAGNETIC HINGE CONNECTION FOR TOILET LID AND SEAT

TECHNICAL FIELD

This disclosure is generally directed to toilet equipment and more particularly to a magnetic hinge connection for a toilet lid and seat.

BACKGROUND

Toilet seats and lids have existed in various forms for many decades. A toilet seat provides a surface for an occupant to comfortably sit and a toilet lid provides a protective cover for the toilet facility. Typically, a toilet seat is affixed to a toilet bowl by placing mounting screws or bolts through a flange portion of the toilet bowl and by fastening washers and screw nuts from the bottom surface of the toilet bowl to the mounting screws. In many cases, once installed, the toilet seat is difficult to remove, such as for cleaning. For example, many toilet seats require screws or mounting bolts to be unfastened from the washers and nuts. In some cases, this process can be cumbersome or difficult to perform. Some so called "quick release" toilet seats exist; however, the hinges on such seats are typically of a complicated design and are often less than reliable due to their complexity.

SUMMARY

This disclosure provides a magnetic hinge connection for use in a hinge assembly of a toilet lid and seat.

In a first embodiment, a hinge assembly for a toilet seat includes a mounting base configured to be coupled to a toilet bowl, the mounting base comprising a mounting cup. The hinge assembly also includes a mounting post configured to be coupled to the toilet seat and configured to be inserted into the mounting cup. At least one of the mounting cup and the mounting post comprises a magnet such that the mounting post and the mounting cup form a magnetic connection when the mounting post is inserted into the mounting cup.

In a second embodiment, a toilet seat assembly includes a toilet seat, a toilet lid, and multiple hinge assemblies pivotally coupling the toilet seat and toilet lid. Each hinge assembly includes a mounting base configured to be coupled to a toilet bowl, the mounting base comprising a mounting cup. Each hinge assembly also includes a mounting post configured to be coupled to the toilet seat and configured to be inserted into the mounting cup. At least one of the mounting cup and the mounting post comprises a magnet such that the mounting post and the mounting cup form a magnetic connection when the mounting post is inserted into the mounting cup.

Other technical features may be readily apparent to one skilled in the art from the following figures, descriptions and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The figures described below and the various embodiments used to describe the principles of the present disclosure in this patent document are by way of illustration only and should not be construed in any way to limit the scope of the disclosure. Those skilled in the art will understand that the principles of the present disclosure may be implemented in any type of suitably arranged device or system.

Many conventional toilet seats are provided with two or more mounting bolts that pass through holes in the flange portion of the toilet bowel. To secure the toilet seat onto the toilet bowl, the mounting bolts are coupled to the toilet seat and inserted through the holes of the toilet bowl. Nuts and washers are then threaded onto the mounting bolts from the bottom side of the toilet bowl. To remove the toilet seat, it is necessary to loosen and unfasten the nuts from the mounting bolts. However, as mounting screws and bolts rust or corrode (especially in a moist environment), the screws or the mounting bolts can become difficult to loosen or unfasten. Furthermore, the nuts can recess due to the passage of time, making the nuts practically inaccessible and removal of the toilet seat very difficult. Even temporary removal of the toilet seat, such as for cleaning, can be very difficult with conventional designs.

To address these and other issues, embodiments of this disclosure provide one or more magnetic hinge connections for use in a hinge assembly of a toilet lid and seat. The magnetic hinge connections provide a strong magnetic bond between separable components and prevent (or reduce the likelihood of) the toilet lid, the toilet seat, or both accidentally separating from the toilet bowl. However, intentional removal of the toilet seat, such as for cleaning, can be easily performed by applying a firm vertical pulling force to the magnetic hinge connections.

It will be understood that embodiments of this disclosure may include any one, more than one, or all of the features described here. In addition, embodiments of this disclosure may additionally or alternatively include other features not listed here. Although the disclosed embodiments are described with respect to a toilet seat and lid, such description is not limiting since the disclosed embodiments are suitable for a wide range of applications.

Figure 1:
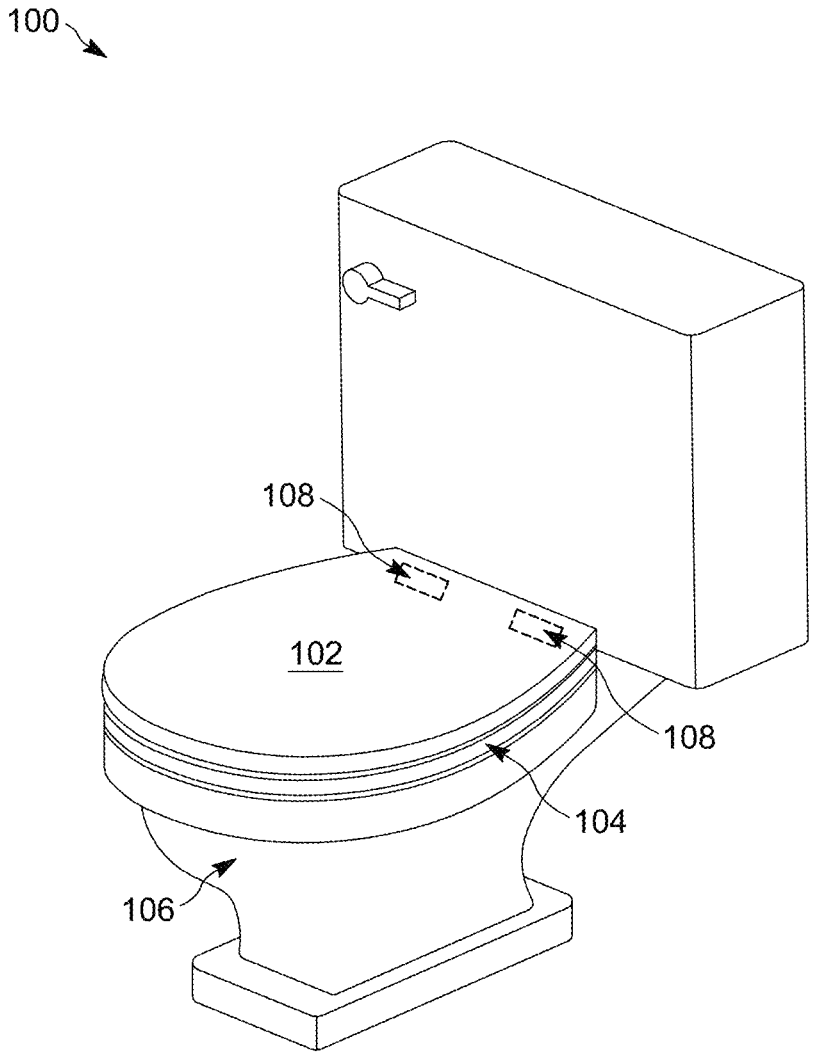
FIG. 1 illustrates a toilet with a toilet lid and seat on which a magnetic hinge connection can be employed, according to this disclosure.

FIG. 1 illustrates a toilet with a toilet lid and seat on which a magnetic hinge connection can be employed, according to this disclosure. The embodiment of the toilet 100 shown in FIG. 1 is for illustration only. Other embodiments of the toilet 100 could be used without departing from the scope of this disclosure. Those skilled in the art will recognize that, for simplicity and clarity, some features and components are not explicitly shown in every figure, including those illustrated in connection with other figures. Such features, including those illustrated in other figures, will be understood to be equally applicable to the toilet 100. It will be understood that all features illustrated in the figures may be employed in any of the embodiments described. Omission of a feature or component from a particular figure is for purposes of simplicity and clarity, and not meant to imply that the feature or component cannot be employed in the embodiments described in connection with that figure.

As shown in FIG. 1, the toilet 100 is fitted with a toilet lid 102 and toilet seat 104 over a bowl 106. The toilet 100 may be any suitable toilet with a bowl that is configured to be covered by a seat and lid. The bowl 106 has an opening that is generally round or oval in shape. The toilet lid 102 and toilet seat 104 have a size and shape configured to generally match the size and shape of the bowl 106 and to cover the opening of the bowl 106. The toilet lid 102 and toilet seat 104 are pivotally coupled to each other and secured to a rear portion of the bowl 106 or toilet 100 using a pair of hinge assemblies 108 that allow the toilet lid 102 and toilet seat 104 to raise and lower independently with respect to the bowl 106 and to each other. The hinge assemblies 108 are secured to a flange portion at the rear of the bowl 106. The hinge assemblies 108 can be configured for easy installation and removal of the toilet lid 102, toilet seat 104, or both. Further details regarding the hinge assemblies 108 are provided below.

Although FIG. 1 depicts one example of a toilet 100 with a toilet lid 102 and toilet seat 104, various changes may be made to FIG. 1. For example, while the bowl 106 is depicted as generally round or oval in shape, the bowl 106 could include other shapes, such as a rectangle or octagon. Likewise, while FIG. 1 illustrates a general placement and arrangement for the hinge assemblies 108 with respect to the toilet 100, this is for illustration purposes only. The exact placement, shape, and quantity of the hinge assemblies 108 could vary depending on the embodiment.

Figure 2:
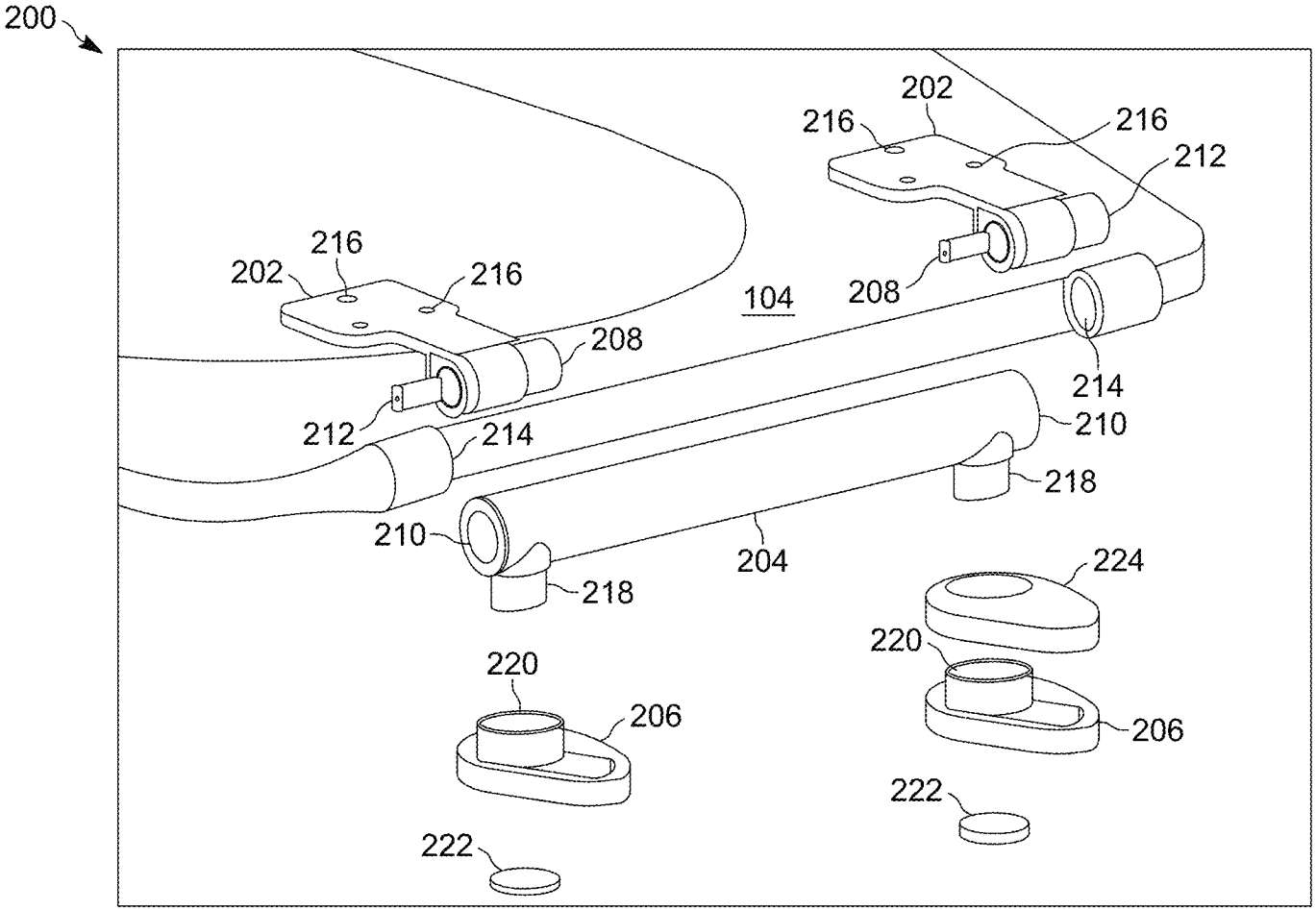
FIG. 2 illustrates an exploded perspective view of an example hinge assembly used in conjunction with a toilet seat according to this disclosure.

FIG. 2 illustrates an exploded perspective view of an example hinge assembly 200 used in conjunction with a toilet seat according to this disclosure. The embodiment of the hinge assembly 200 shown in FIG. 2 is for illustration only. Other embodiments of the hinge assembly 200 could be used without departing from the scope of this disclosure. For example, the hinge assembly 200 could additionally or alternatively be used in conjunction with a toilet lid. For ease of explanation, the hinge assembly 200 may represent either or both of the hinge assemblies 108 of FIG. 1. It will be understood, however, that the hinge assembly 200 may represent any other suitable hinge assembly.

As shown in FIG. 2, the hinge assembly 200 includes multiple hinge leaves 202, a hinge center bar 204, and multiple mounting bases 206. The hinge leaves 202 are provided to join the toilet seat 104, a corresponding toilet lid (e.g., the toilet lid 102, not shown in FIG. 2), and the hinge center bar 204 together to form an operable assembly. Each hinge leaf 202 includes an inward post 208 configured to fit into a corresponding end aperture 210 of the hinge center bar 204. Each hinge leaf 202 also includes an outward post 212 configured to fit into a corresponding aperture 214 of the toilet seat 104. In addition, each hinge leaf 202 includes one or more fastener holes 216 through which fasteners (not shown) can be placed to attach the hinge leaf 202 to the toilet lid.

The hinge center bar 204 is generally elongate and may have a circular cross section, as shown in FIG. 2. When the hinge assembly 200 is assembled, the hinge center bar 204 extends between the hinge leaves 202, which are each coupled to the toilet seat 104 via the outward posts 212. The hinge center bar 204 provides a fixed fulcrum from which the toilet seat 104 and the toilet lid 102 can pivot up and down. The hinge center bar 204 includes mounting posts 218 that project outward from the hinge center bar 204 at or near each end of the hinge center bar 204. When the toilet seat 104 is mounted to the toilet bowl (e.g., the toilet bowl 106, not shown in FIG. 2), the mounting posts 218 are inserted (e.g., vertically downward) into mounting cups 220 disposed on top surfaces of the mounting bases 206.

The mounting bases 206 are configured to be anchored to the toilet bowl (e.g., using one or more fasteners) before the toilet seat 104 is mounted to the toilet bowl. Each mounting base 206 can be formed of any suitable material, such as one or more plastics, aluminum, zinc, metallic alloys, or a combination of these. Once the mounting bases 206 are anchored to the toilet bowl, the toilet seat 104 can be mounted to the toilet bowl by inserting the mounting posts 218 into the mounting cups 220 of the mounting bases 206. Magnets 222 form portions of a magnetic connection that firmly holds the toilet seat 104 in a mounted position on the toilet bowl, and prevents (or reduces the likelihood of) accidental separation of the toilet seat 104 from the toilet bowl, as described in greater detail below. However, intentional removal of the toilet seat 104, such as for cleaning, can be easily performed by applying a firm vertical pulling force to overcome the magnetic connection. In some embodiments, a decorative cap 224 can be placed over each mounting base 206 to hide portions of the mounting base 206 and thus provide a more aesthetic look.

Figure 3:
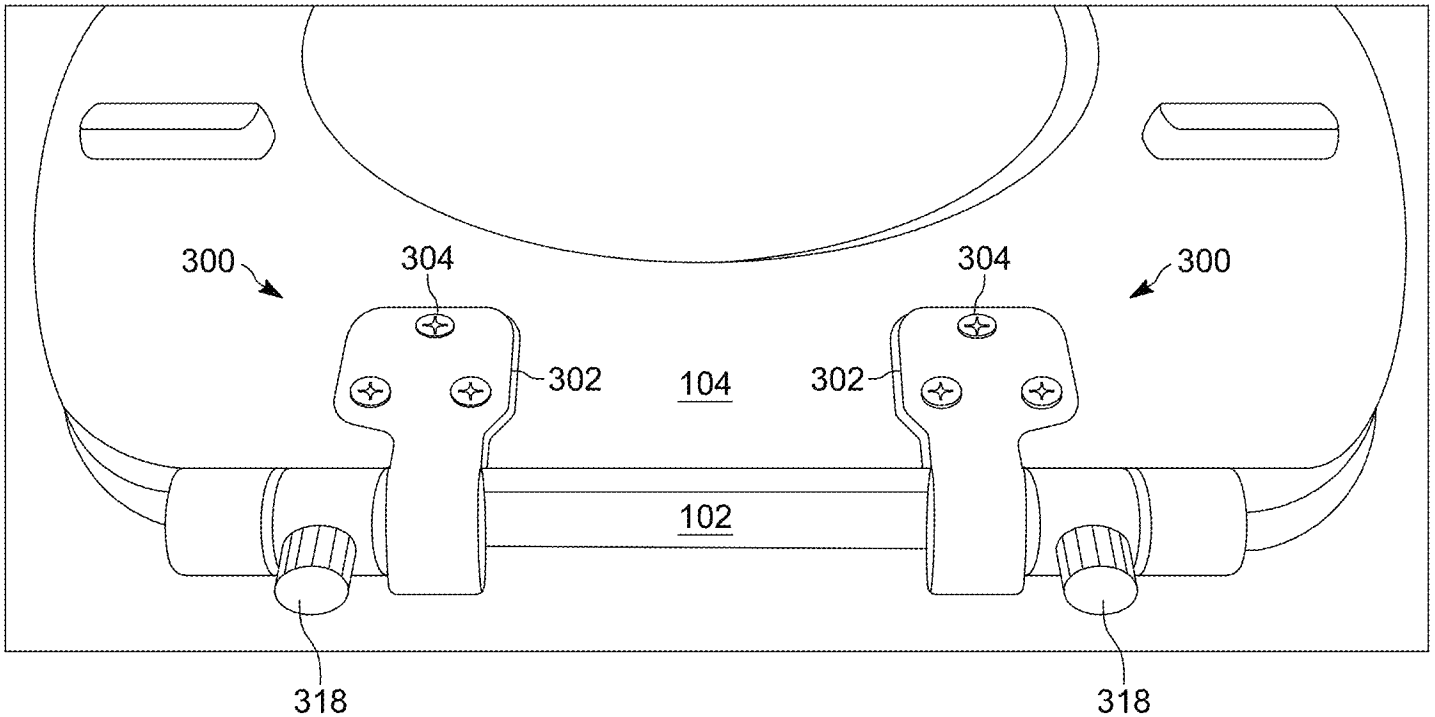
FIG. 3 illustrates a perspective view of example hinge assemblies installed on a toilet seat according to this disclosure.

FIG. 3 illustrates a perspective view of example hinge assemblies 300 installed on a toilet seat according to this disclosure. The embodiment of the hinge assemblies 300 shown in FIG. 3 is for illustration only. Other embodiments of the hinge assemblies 300 could be used without departing from the scope of this disclosure. The embodiment of the hinge assemblies 300 shown in FIG. 3 is for illustration only.

Other embodiments of the hinge assemblies 300 could be used without departing from the scope of this disclosure. For ease of explanation, the hinge assemblies 300 may represent the hinge assemblies 108 of FIG. 1. It will be understood, however, that the hinge assemblies 300 may represent any other suitable hinge assembly.

As shown in FIG. 3, a pair of hinge assemblies 300 are provided to couple the toilet lid 102 to the toilet seat 104 and to provide a means to mount the toilet lid/seat assembly to the toilet bowl (not shown in FIG. 3). The hinge assemblies 300 have some similarities to (and some components in common with) the hinge assembly 200 of FIG. 2. However, there are two separate hinge assemblies 300 spaced apart in FIG. 3, while the hinge assembly 200 is a single hinge assembly that spans most of the rear edge of the toilet seat 104 and toilet lid 102.

Each hinge assembly 300 includes a hinge leaf 302 that is attached to the toilet seat 104 using one or more fasteners 304. Other portions of each hinge assembly 300 are attached to the toilet lid 102 using one or more other fasteners (not shown). Each hinge assembly 300 also includes a mounting post 318 that projects outward from the hinge assembly 300. When the toilet seat 104 is mounted to the toilet bowl (e.g., the toilet bowl 106, not shown in FIG. 2), the mounting posts 318 are inserted (e.g., vertically downward) into openings of mounting bases (e.g., the mounting bases 206). As described in greater detail below, magnets form portions of a magnetic connection that firmly holds the toilet seat 104 in a mounted position on the toilet bowl. Depending on the embodiment, the magnets may be included as part of the mounting posts 318, part of the mounting bases, or a combination of these. The magnetic connection firmly holds the toilet seat 104 in a mounted position on the toilet bowl, and prevents (or reduces the likelihood of) accidental separation of the toilet seat 104 from the toilet bowl.

Figure 4B:
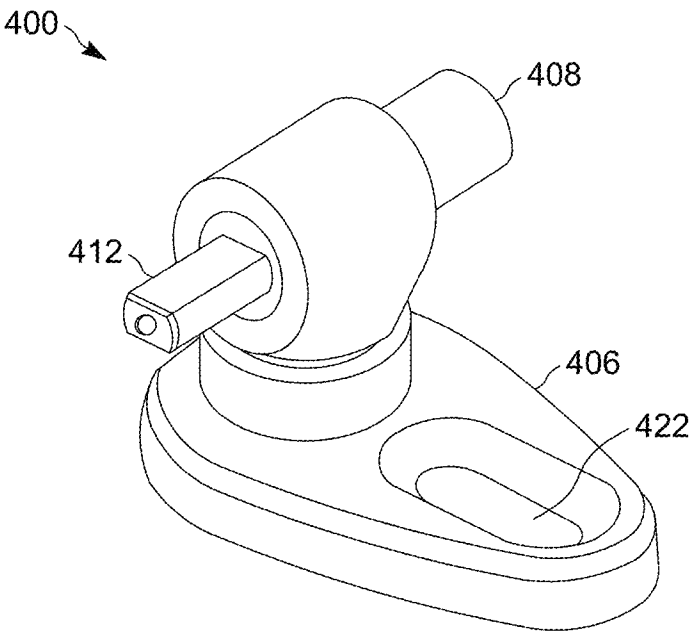
FIGS. 4A and 4B illustrate portions of a hinge assembly that includes a magnetic connection according to this disclosure.
Figure 4A:
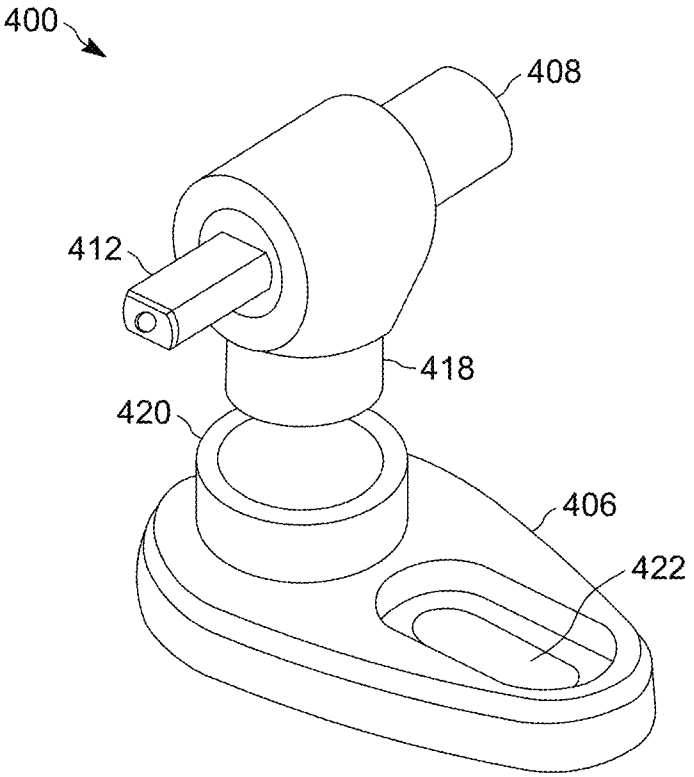

FIGS. 4A and 4B illustrate portions of a hinge assembly 400 that includes a magnetic connection according to this disclosure. In particular, FIG. 4A illustrates the hinge assembly 400 in a disconnected state, and FIG. 4B illustrates the hinge assembly 400 in a connected state. The embodiment of the hinge assembly 400 shown in FIG. 4 is for illustration only. Other embodiments of the hinge assembly 400 could be used without departing from the scope of this disclosure.

The hinge assembly 400 includes multiple components that are the same as (or similar to) corresponding components of the hinge assembly 200 and the hinge assembly 300. As shown in FIGS. 4A and 4B, the hinge assembly 400 includes a mounting base 406, an inward post 408, an outward post 412, a mounting post 418, and a mounting cup 420. The inward post 408 and the outward post 412 are oriented horizontally and are provided to couple this portion of the hinge assembly 400 to one or more hinge leaves (e.g., the hinge leaf 202, not shown in FIGS. 4A and 4B). That is, the hinge assembly 400 is one of a pair of hinge assemblies configured to be attached to a toilet seat and toilet lid via hinge leaves, such as shown in FIGS. 2 and 3.

The mounting post 418 is the same as, or similar to, the mounting posts 218 and 318 shown in FIGS. 2 and 3. The mounting cup 420 is the same as, or similar to, the mounting cups 220 of FIG. 2. The mounting post 418, the mounting cup 420, or both include one or more magnets that form portions of a magnetic connection between the mounting post 418 and the mounting cup 420.

The mounting base 406 includes a slotted opening 422 configured to accept a fastener (e.g., a bolt, not shown). The mounting base 406 can be formed of any suitable material, such as one or more plastics, aluminum, zinc, metallic alloys, or a combination of these. To install the toilet seat, two mounting bases 406 are placed on the toilet bowl, and one or more fasteners are inserted through the slotted opening 422 of each mounting base 406 and a corresponding opening in the rear flange of the toilet bowl. The mounting bases 406 are then secured to the toilet bowl with the fasteners (e.g., tightening a nut and bolt). The shape of the slotted opening 422 allows some freedom of position of the mounting bases 406 on the toilet bowl to account for different hole spacings among different toilet models. Once the mounting bases 406 are secured to the toilet bowl, the mounting posts 418 are inserted (e.g., vertically downward) into the mounting cups 420. The magnetic connection between the mounting post 418 and the mounting cup 420 firmly and securely holds the toilet seat in a mounted position on the toilet bowl.

Figure 5A:
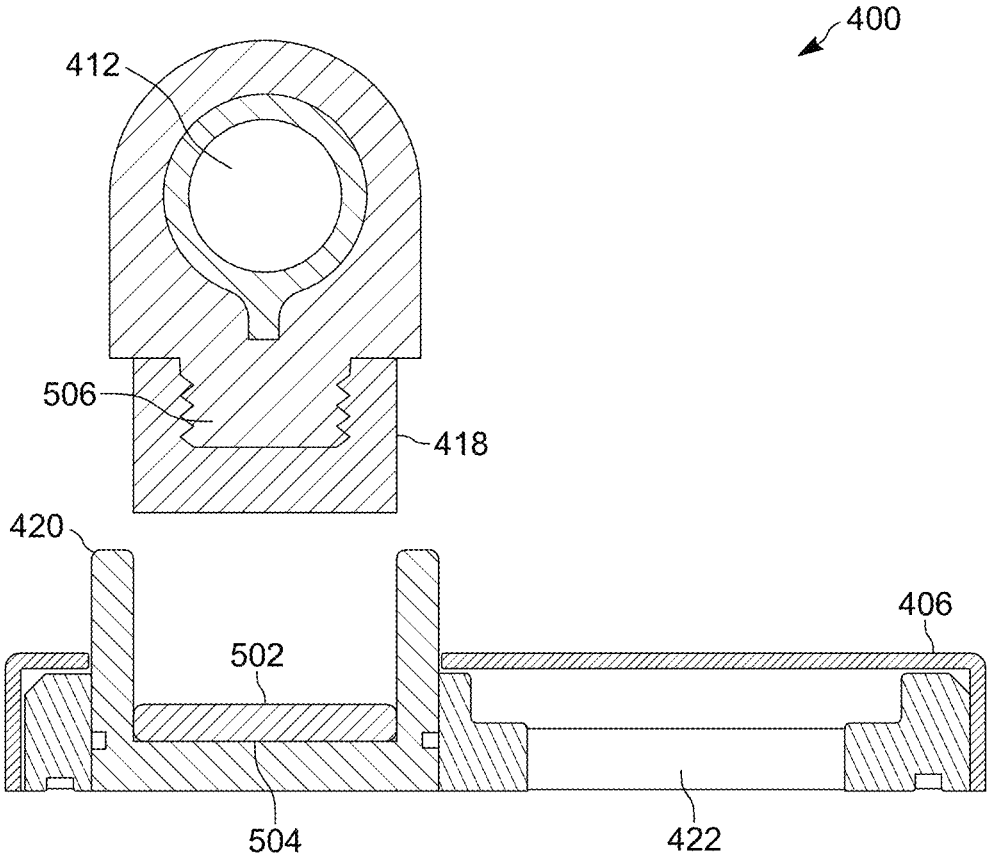
FIGS. 5A and 5B illustrate additional details of the hinge assembly of FIGS. 4A and 4B according to this disclosure.
Figure 5B:
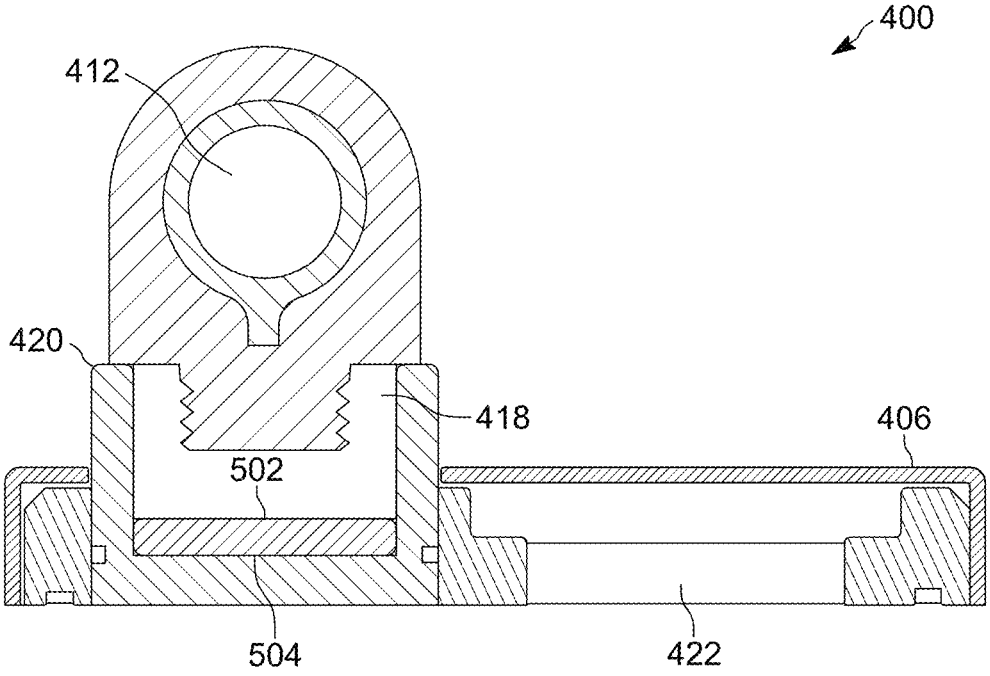

FIGS. 5A and 5B illustrate additional details of the hinge assembly 400 according to this disclosure. In particular, FIG. 5A shows a cross-sectional view of the hinge assembly 400 in a disconnected state, and FIG. 5B shows a cross-sectional view of the hinge assembly 400 in a connected state.

As shown in FIGS. 5A and 5B, the mounting cup 420 includes a magnet 502 attached to a bottom surface 504 of the mounting cup 420. The magnet 502 can be a metallic magnet, a ceramic magnet, a cup magnet, a disk magnet, any other suitable type of magnet, or any combination of these. The sides and bottom portion of the mounting cup 420 can be integrally formed, and can be formed of metal or metallic alloy, such as iron or steel. After the mounting cup 420 is formed, the magnet 502 is placed into the mounting cup 420 and secured to the bottom surface 504, such as by adhesive or fastener.

The mounting post 418 is formed as a threaded cap that screws onto a threaded post 506 of the top portion of the hinge assembly 400. The mounting post 418 can be formed of a metal or metallic alloy that is attracted to the magnet 502, such as iron or steel. When the mounting post 418 is inserted into the mounting cup 420, as shown in FIG. 5B, the mounting post 418 makes a secure magnetic connection with the magnet 502. Experimentation has demonstrated that forming the mounting post 418 and the mounting cup 420 of iron results in a stronger magnetic connection for a given magnet 502 than forming the mounting post 418 and the mounting cup 420 of steel or another metallic alloy. In particular, the vertically arranged layers of iron, magnet, and iron (represented by the bottom of the mounting post 418, the magnet 502, and the bottom of the mounting cup 420, respectively) result in a very strong magnetic connection that requires significant pulling force (e.g., greater than ten pounds) to separate. However, the mounting post 418 and the mounting cup 420 can each be formed of any suitable material(s), including the same material(s) or different material(s).

Figure 6A:
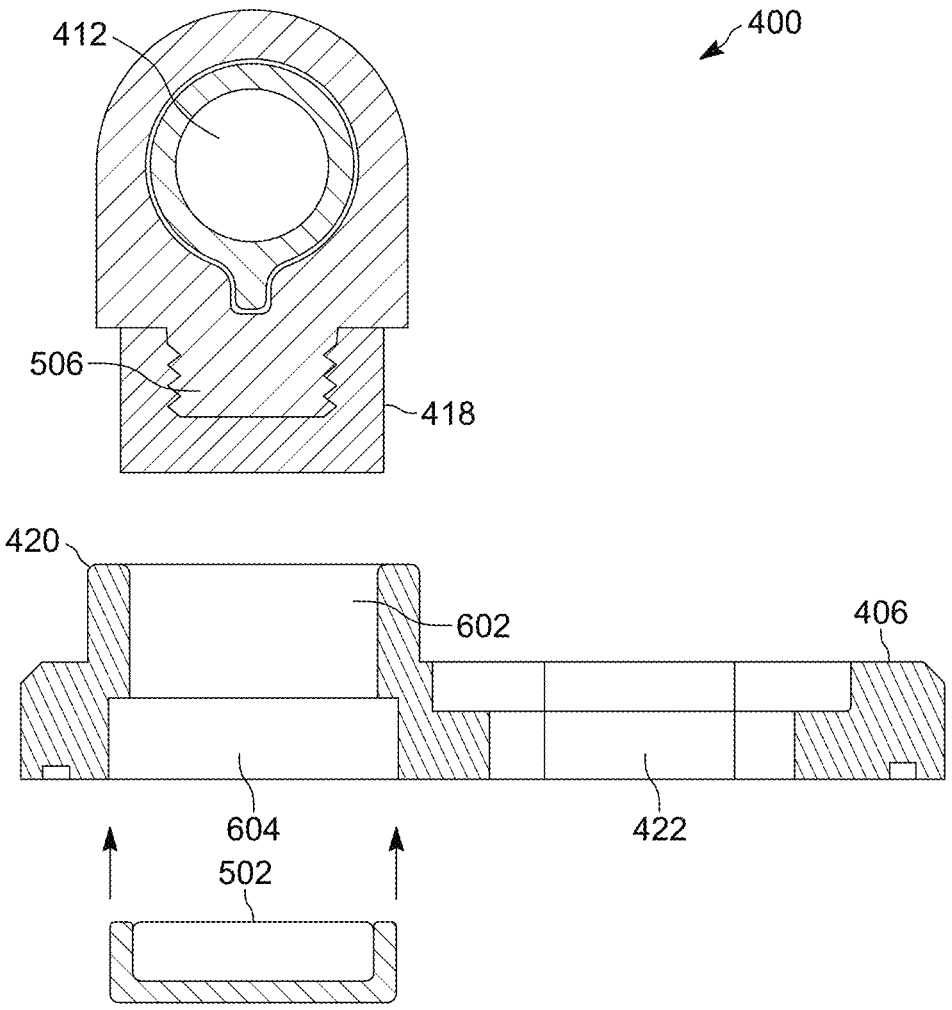
FIGS. 6A through 6D illustrate another embodiment of the hinge assembly of FIGS. 4A and 4B according to this disclosure.
Figure 6B:
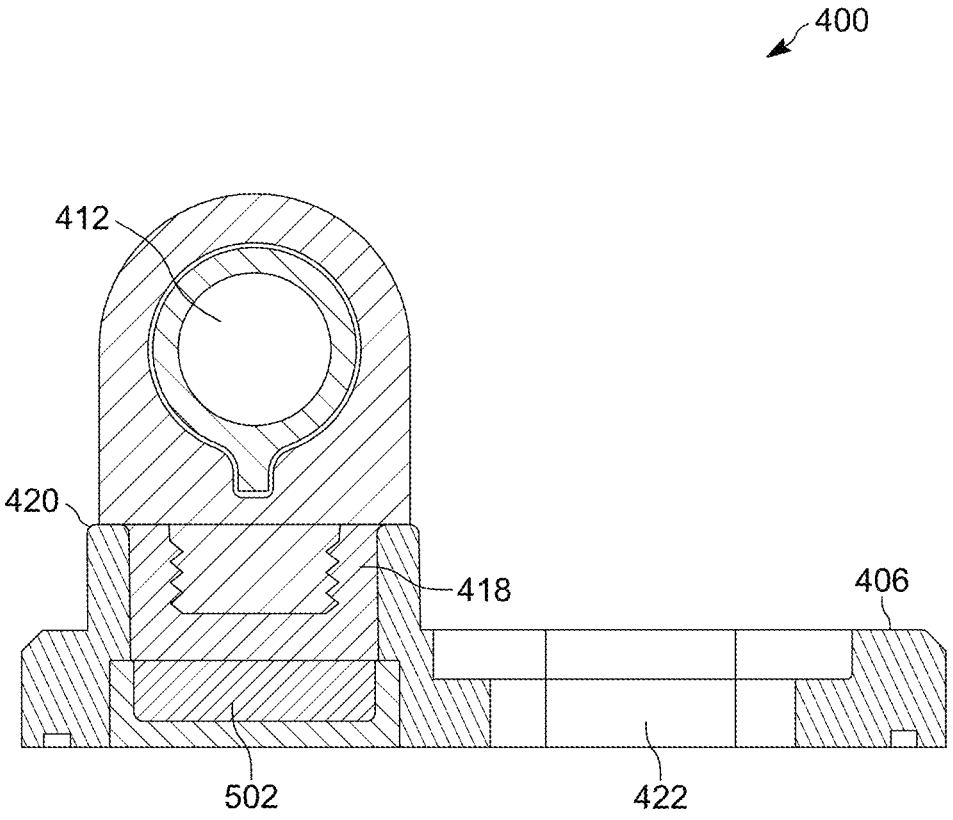
Figure 6C:
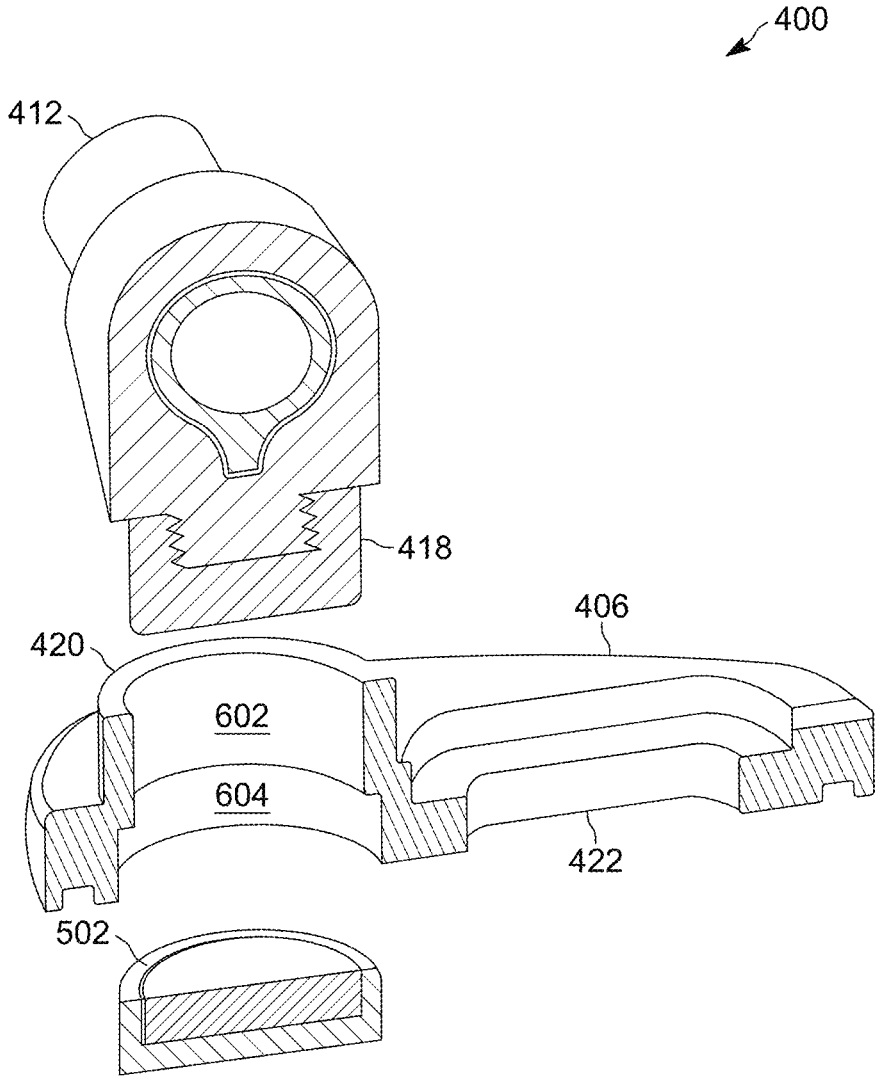
Figure 6D:
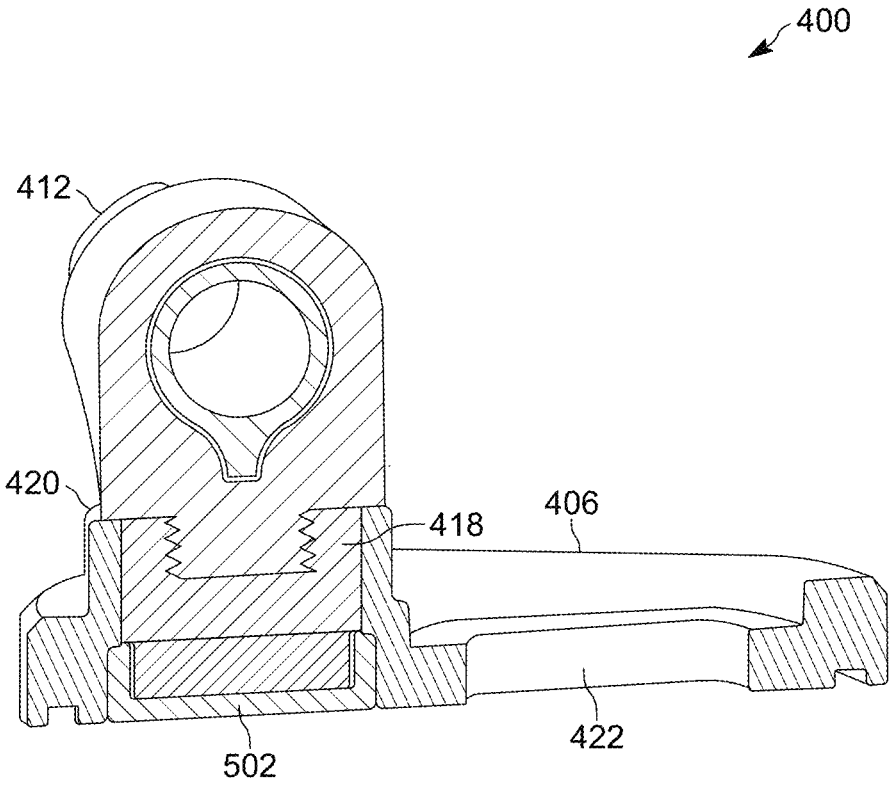

FIGS. 6A through 6D illustrate another embodiment of the hinge assembly 400 according to this disclosure. In particular, FIG. 6A shows a cross-sectional elevation view of the hinge assembly 400 in a disconnected state, FIG. 6B shows a cross-sectional elevation view of the hinge assembly 400 in a connected state, FIG. 6C shows a cross-sectional perspective view of the hinge assembly 400 in a disconnected state, and FIG. 6D shows a cross-sectional perspective view of the hinge assembly 400 in a connected state.

As shown in FIGS. 6A through 6D, the mounting cup 420 includes two vertically arranged sections: a first section 602 and a second section 604 below the first section 602. The first section 602 has a diameter configured to receive the mounting post 418. That is, the diameter of the first section 602 is slightly larger than the diameter of the mounting post 418. The second section 604 has a diameter that is larger than the first section 602 and corresponds to the diameter of the magnet 502. In FIGS. 6A through 6D, the magnet 502 is shown as a cup magnet, which is a magnet surrounded by a metallic (e.g., steel) cup. The cup can facilitate attachment of the magnet 502 and can also increase the holding force of the magnet 502. The diameter of the magnet 502 is larger than the diameter of the first section 602.

As shown in FIG. 6A, during manufacturing of the hinge assembly 400, the magnet 502 is inserted into the second section 604 of the mounting cup 420 from the bottom, thus forming the completed mounting cup 420. Later, to install the toilet seat on a toilet, two mounting bases 406 are placed on the toilet bowl, and one or more fasteners are inserted through the slotted opening 422 of each mounting base 406 and a corresponding opening in the rear flange of the toilet bowl. The mounting bases 406 are then secured to the toilet bowl with the fasteners (e.g., tightening a nut and bolt). Once the mounting bases 406 are secured to the toilet bowl, the mounting posts 418 are inserted (e.g., vertically downward) into the mounting cups 420. The magnetic connection between the mounting post 418 and the magnet 502 firmly and securely holds the toilet seat in a mounted position on the toilet bowl.

Figure 7A:
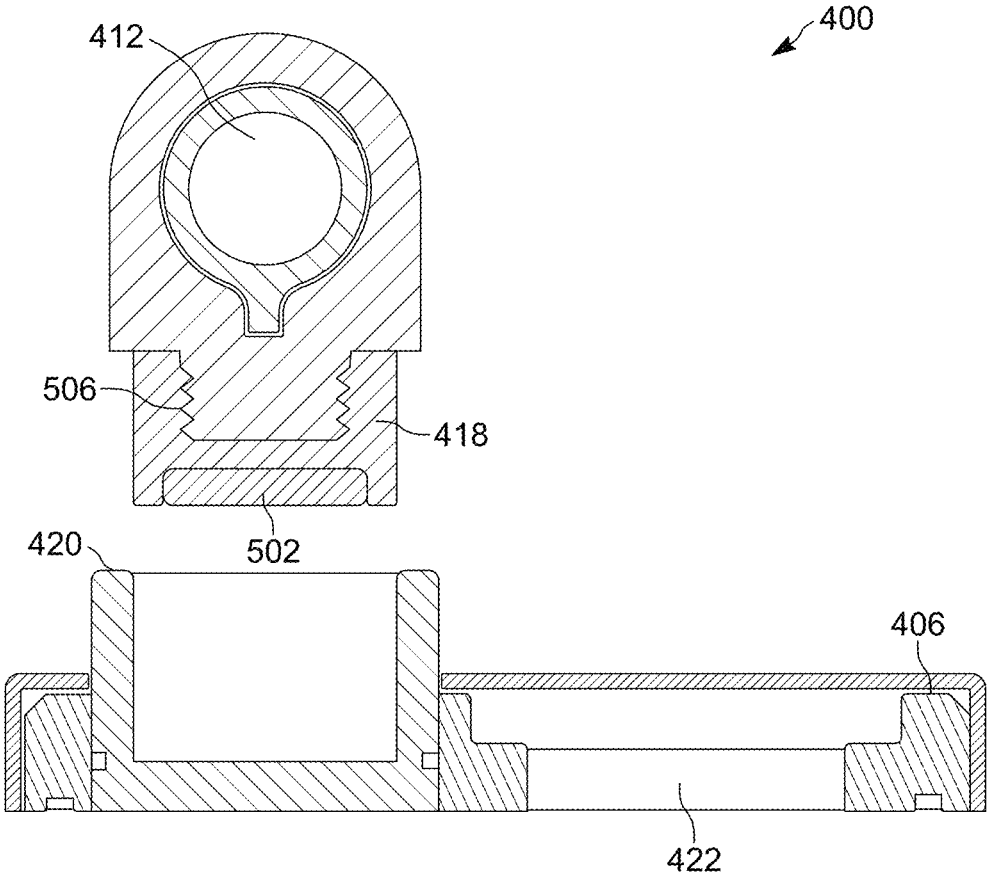
FIGS. 7A and 7B illustrate yet another embodiment of the hinge assembly of FIGS. 4A and 4B according to this disclosure.
Figure 7B:
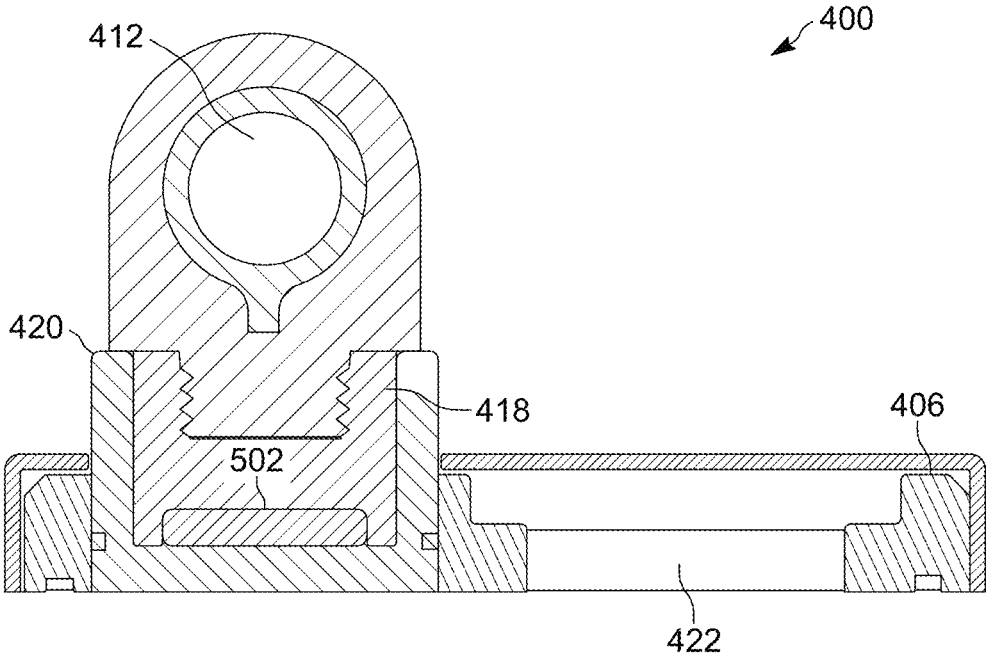

FIGS. 7A and 7B illustrate yet another embodiment of the hinge assembly 400 according to this disclosure. In particular, FIG. 7A shows a cross-sectional elevation view of the hinge assembly 400 in a disconnected state, and FIG. 7B shows a cross-sectional elevation view of the hinge assembly 400 in a connected state.

As shown in FIGS. 7A and 7B, in this embodiment, the magnet 502 is disposed in an end portion of the mounting post 418, rather than in the mounting cup 420. That is, during manufacturing of the hinge assembly 400, the magnet 502 is inserted into the end portion of the mounting post 418. Later, to install the toilet seat on a toilet, each mounting post 418 is inserted into the corresponding mounting cup 420, so that the magnet 502 forms a magnetic connection with the bottom surface of the mounting cup 420.

Figure 8A:
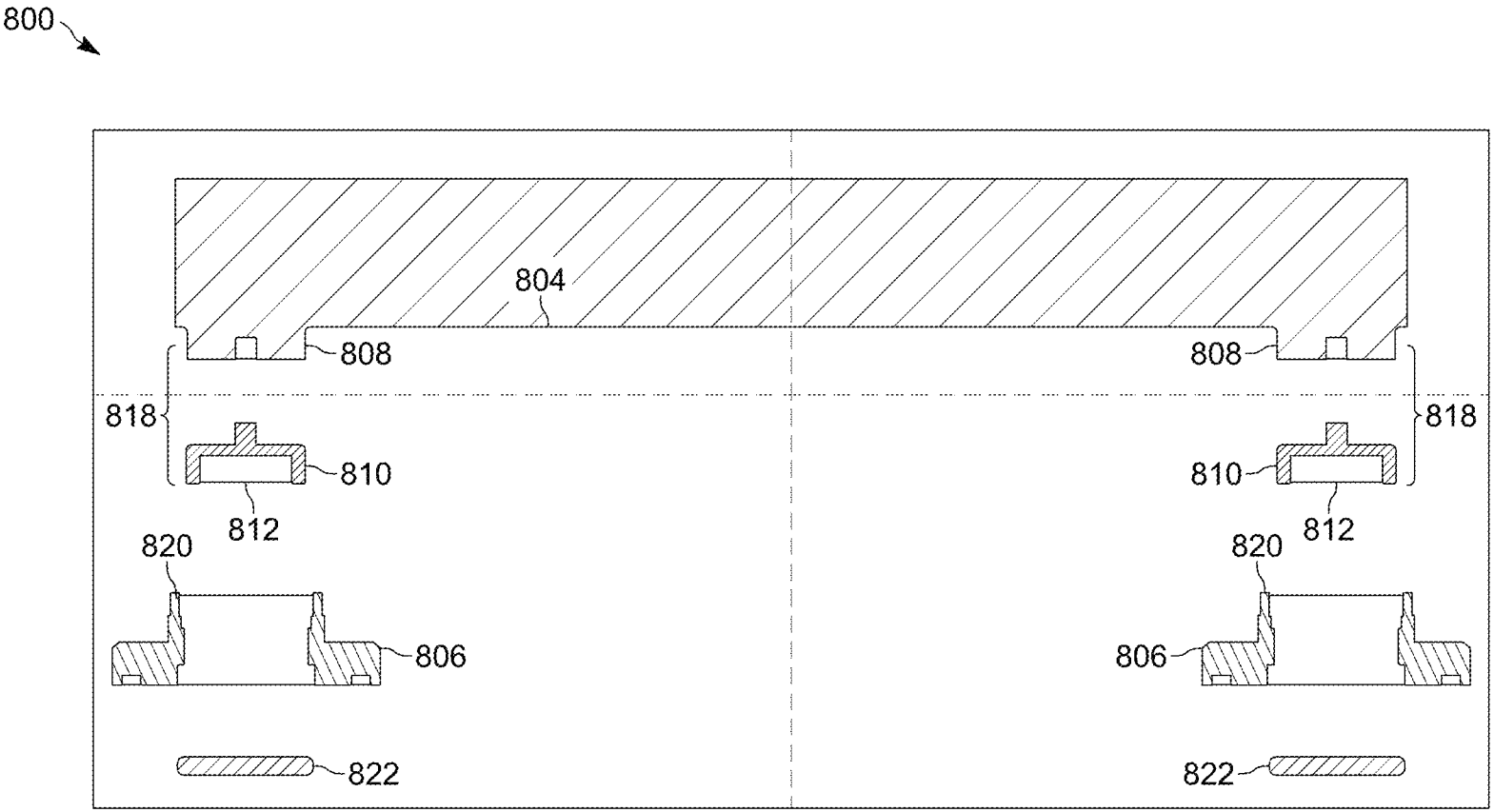
FIGS. 8A and 8B illustrate another example hinge assembly according to this disclosure.
Figure 8B:
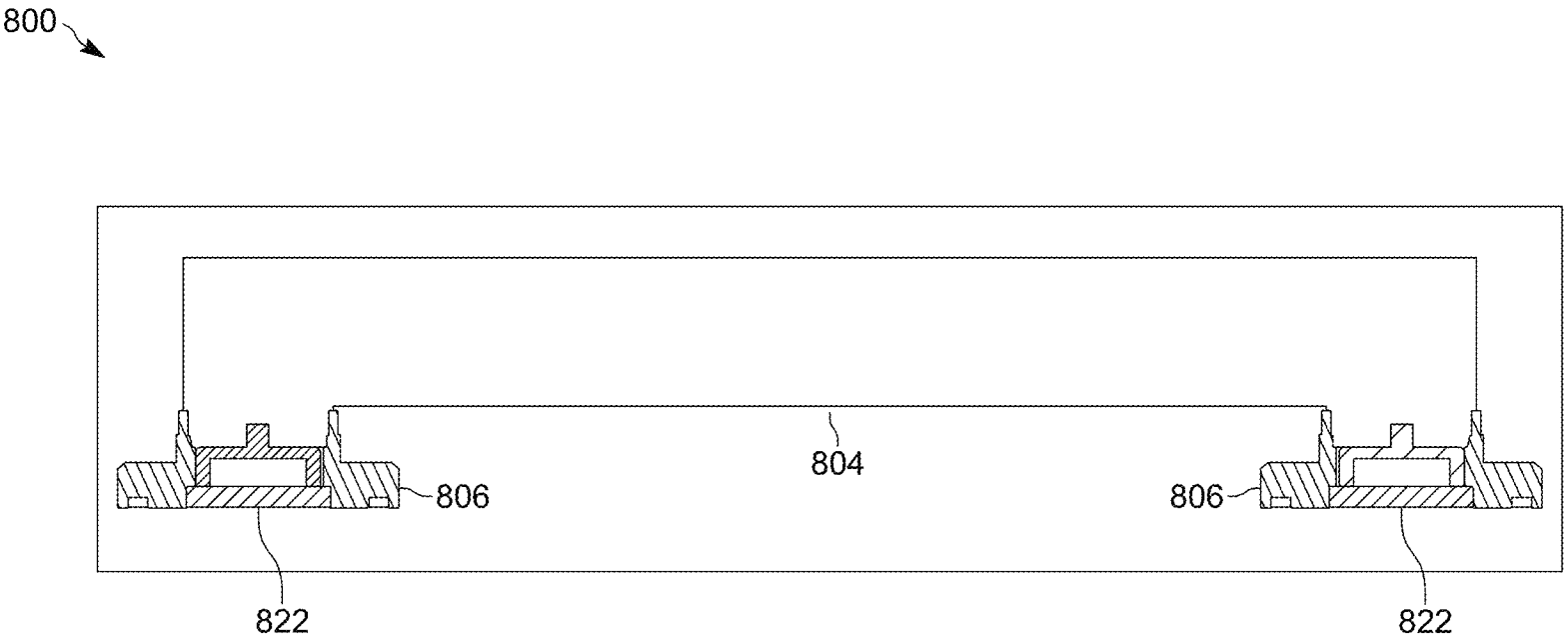

FIGS. 8A and 8B illustrate another example hinge assembly 800 according to this disclosure. In particular, FIG. 8A shows a cross-sectional elevation view of the hinge assembly 800 in a disconnected state, and FIG. 8B shows a cross-sectional elevation view of the hinge assembly 800 in a connected state.

As shown in FIGS. 8A and 8B, the hinge assembly 800 includes a center bar 804 and multiple mounting bases 806. The center bar 804 can be similar to the hinge center bar 204 of FIG. 2. The center bar 804 is generally elongate and may have a circular cross section. The center bar 804 is configured to attach to a toilet lid and toilet seat (not shown), such as via one or more hinge leaves (not shown). The center bar 804 includes mounting posts 818 that project outward from the center bar 804 at or near each end of the center bar 804. Each mounting post 818 includes an extension part 808 and a magnetic part 810 that attaches to (e.g., screws into) the bottom surface of the extension part 808. The magnetic part 810 includes a magnet 812, such as a cup magnet or another suitable magnet.

Each of the mounting bases 806 includes a mounting cup 820 disposed on the top surface of the mounting base 806. Each mounting base 806 can be the same as, or similar to, any of the mounting bases 206 or 406 described earlier. As shown in FIGS. 8A and 8B, each mounting base 806 includes a magnet 822 disposed in a bottom section of the mounting base 806. When the toilet seat is mounted to the toilet bowl, the mounting posts 818 are inserted (e.g., vertically downward) into the mounting cups 820, as shown in FIG. 8B. The magnets 812 and 822 come in contact with each other, forming a magnetic connection that firmly holds the toilet seat in a mounted position on the toilet bowl.

Although FIGS. 2 through 8B depict details of various example hinge assemblies, various changes may be made to FIGS. 2 through 8B. For example, while shown comprised of certain components, the hinge assemblies 200, 300, 400, 800 may include more or fewer components. Components shown in FIGS. 2 through 8B may be removed, repeated, or arranged in a different order. Components may have dimensions other than those shown or described. Other components, composed of the same or different materials, may be added to any of the hinge assemblies 200, 300, 400, 800.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle. Use of any other term, including without limitation "mechanism," "module," "device," "unit," "component," "element," "member," "apparatus," "machine," "system," "processor," or "controller," within a claim is understood by the applicants to refer to structures known to those skilled in the relevant art and is not intended to invoke 35 U.S.C. § 112(f).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A hinge assembly for a toilet seat, the hinge assembly comprising:

a mounting base configured to couple to a toilet bowl, the mounting base comprising a mounting cup; and a mounting post configured to couple to the toilet seat and configured to insert into the mounting cup, wherein at least one of the mounting cup and the mounting post comprises a magnet such that the mounting post and the mounting cup form a magnetic connection when the mounting post is inserted into the mounting cup, and wherein the magnet is surrounded by a metallic cup such that the magnet comprises a cup magnet.

2. The hinge assembly of claim 1, wherein the magnet is attached to a bottom surface of the mounting cup.

3. A hinge assembly for a toilet seat, the hinge assembly comprising:

a mounting base configured to couple to a toilet bowl, the mounting base comprising a mounting cup; and a mounting post configured to couple to the toilet seat and configured to insert into the mounting cup, wherein at least one of the mounting cup and the mounting post comprises a magnet such that the mounting post and the mounting cup form a magnetic connection when the mounting post is inserted into the mounting cup, and wherein the mounting post comprises a threaded cap configured to attach to a threaded post disposed at a top portion of the hinge assembly.

4. The hinge assembly of claim 1, wherein the mounting base comprises a slotted opening configured to accept a fastener for attaching the mounting base to the toilet bowl.

5. The hinge assembly of claim 1, wherein:

at least one of the mounting post and the mounting cup is formed at least partially of iron, and the magnetic connection comprises the magnet and the iron.

6. The hinge assembly of claim 1, wherein the mounting cup comprises:

a first section configured to receive the mounting post; and a second section disposed below the first section, configured to receive the magnet, and having a larger diameter than a diameter of the first section.

7. The hinge assembly of claim 1, wherein the hinge assembly is one of two hinge assemblies disposed at opposite ends of a center bar.

8. The hinge assembly of claim 1, further comprising:

at least one hinge leaf configured to couple the hinge assembly to the toilet seat.

9. A toilet seat assembly comprising:

a toilet seat;

a toilet lid; and multiple hinge assemblies pivotally coupling the toilet seat and toilet lid, each hinge assembly comprising:

a mounting base configured to couple to a toilet bowl, the mounting base comprising a mounting cup; and a mounting post configured to couple to the toilet seat and configured to insert into the mounting cup, wherein at least one of the mounting cup and the mounting post comprises a magnet such that the mounting post and the mounting cup form a magnetic connection when the mounting post is inserted into the mounting cup, and wherein the magnet is surrounded by a metallic cup such that the magnet comprises a cup magnet.

10. The toilet seat assembly of claim 9, wherein the magnet is attached to a bottom surface of the mounting cup.

11. The toilet seat assembly of claim 9, wherein the mounting cup comprises an annular sidewall configured to surround the metallic cup of the cup magnet.

12. The toilet seat assembly of claim 9, wherein the mounting post comprises a threaded cap configured to attach to a threaded post disposed at a top portion of that hinge assembly.

13. The toilet seat assembly of claim 9, wherein the mounting base comprises a slotted opening configured to accept a fastener for attaching the mounting base to the toilet bowl.

14. The toilet seat assembly of claim 9, wherein:

at least one of the mounting post and the mounting cup is formed at least partially of iron, and the magnetic connection comprises the magnet and the iron.

15. The toilet seat assembly of claim 9, wherein the mounting cup comprises:

a first section having a diameter configured to receive the mounting post;

a second section disposed below the first section and having a diameter configured to receive the magnet; and the magnet has a larger diameter than the mounting post.

16. The toilet seat assembly of claim 9, wherein the multiple hinge assemblies comprise two hinge assemblies disposed at opposite ends of a center bar.

17. The toilet seat assembly of claim 9, further comprising:

at least one hinge leaf configured to couple each hinge assembly to the toilet seat.

18. The hinge assembly of claim 6, wherein:

the cup magnet is configured to pass through an opening from a bottom of the mounting cup;

the diameter of the first section is an inner diameter larger than a diameter of the mounting post;

the diameter of the second section is a second inner diameter that corresponds to a diameter of the magnet; and the magnet has a larger diameter than the mounting post.

* * * * *